US005104847A

United States Patent [19]

Hann et al.

[11] Patent Number: 5,104,847

[45] Date of Patent: Apr. 14, 1992

[54] THERMAL TRANSFER PRINTING DYESHEET AND DYE BARRIER COMPOSITION THEREFOR

[75] Inventors: Richard A. Hann; Barry Pack, both of Ipswich, England

[73] Assignee: Imperial Chemical Industries plc, London, England

[21] Appl. No.: 262,590

[22] Filed: Oct. 26, 1988

[30] Foreign Application Priority Data

Oct. 30, 1987 [GB] United Kingdom ..... 8725454

[51] Int. Cl.[5] ..... B41M 5/035; B41M 5/26

[52] U.S. Cl. ..... 503/227; 8/471; 428/195; 428/413; 428/423.1; 428/482; 428/500; 428/522; 428/913; 428/914

[58] Field of Search ..... 428/913, 522, 195, 413, 428/423.1, 482, 500, 914; 8/470, 471; 503/227

[56] References Cited

U.S. PATENT DOCUMENTS 4,027,345 6/1977 Fujisawa et al. ..... 428/913
4,695,288 9/1987 Ducharme ..... 8/471
4,700,208 10/1987 Vanier et al. ..... 503/227

*Primary Examiner*—Bruce H. Hess
*Attorney, Agent, or Firm*—Cushman, Darby & Cushman

[57] ABSTRACT

To enhance the optical density of colors produced by thermal transfer printing, a dyesheet is used having an intermediate dye-barrier layer between the substrate and the dyecoat. This layer consists essentially of a reaction product of polymerizing acrylic functional groups in a layer of a coating composition comprising: (a) an organic resin comprising at least one polyfunctional material having a plurality of pendant or terminal acrylic groups per molecule available for cross-linking, at least 50% by weight of the polyfunctional material having at least 4 such acrylic functional groups per molecule; and (b) at least one linear organic polymer soluble or partially soluble in the resin, and comprising 1–40% by weight of the resin/polymer mixture.

5 Claims, 1 Drawing Sheet

THERMAL TRANSFER PRINTING DYESHEET AND DYE BARRIER COMPOSITION THEREFOR

The invention relates to thermal transfer printing in which one or more dyes are caused to transfer from a dyesheet to a receiver sheet in response to thermal stimulae applied to selected areas of the dyesheet by a thermal printer head, and in particular to dyesheets for such printing processes.

Dyesheets generally consist essentially of a sheet-like substrate, such as paper or more usually thermoplastic film, supporting on one surface a dyecoat containing a thermal transfer dye, and often on the other surface a backcoat to afford to the thermoplastic substrate at least some protection against the heat from the printer head. The substrate film is typically polyester film, such as "Melinex" polyethyleneterephthalate film (manufactured by Imperial Chemical Industries PLC), although other polymers such as polyamides have also been proposed.

During printing, heat is applied to selected areas of the other surface of the substrate film by the printer head, the heat travelling through the substrate to transfer dye from corresponding areas of the dyecoat to a receptive surface held adjacent to the dyecoat.

BRIEF DESCRIPTION OF THE DRAWINGS

Further objects and advantages of the present invention will be better understood by carefully reading the following detailed description of the presently preferred exemplary embodiments of this invention in conjunction with the accompanying drawing, wherein.

DETAILED DESCRIPTION OF THE INVENTION

Figure 1:
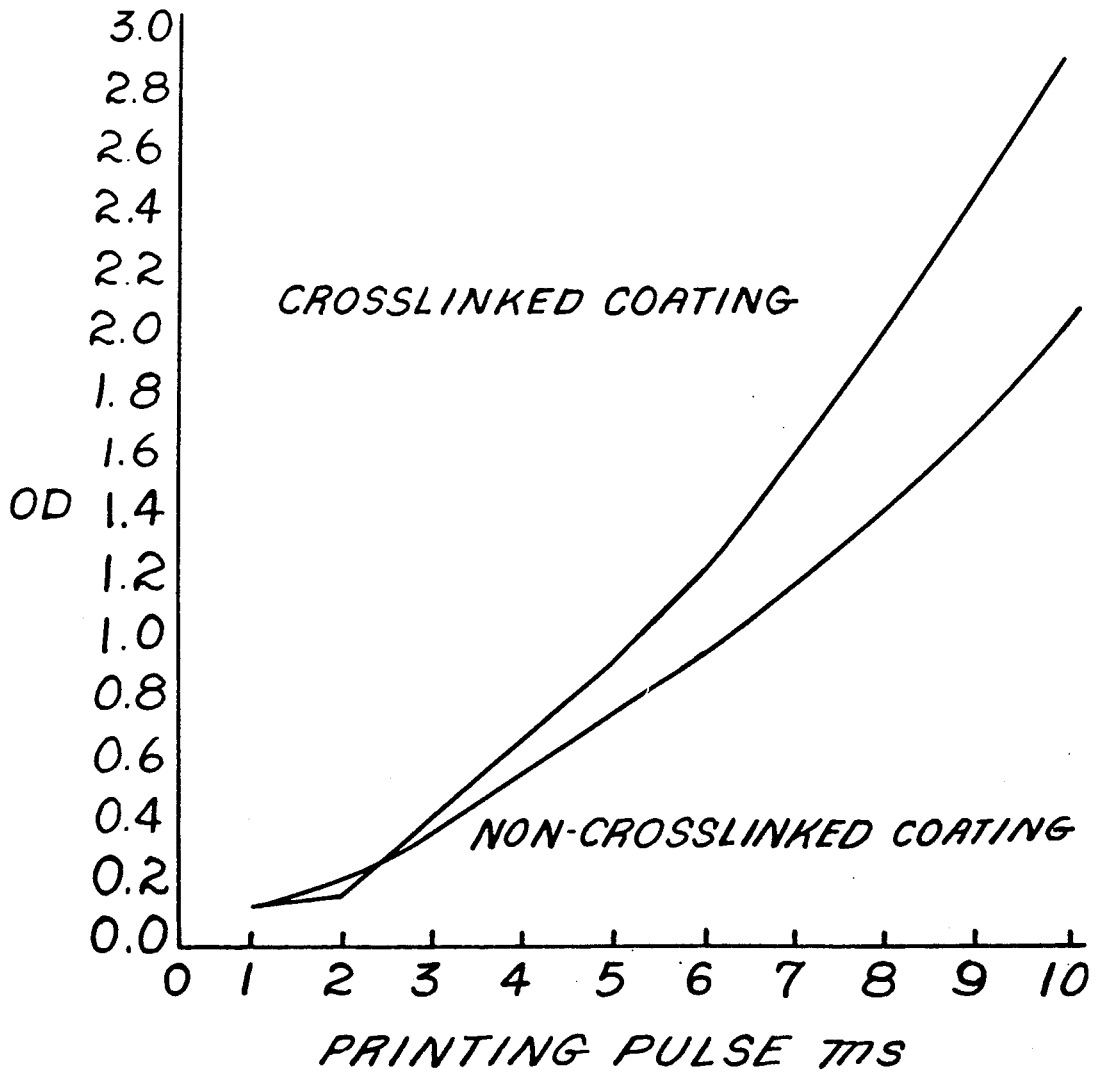
FIG. 1 is a graph which illustrates the effect of having the dye barrier layer of the present invention.

Dyesheets are most conveniently used in the form of an elongated strip, e.g. rolled up in a cassette, so that when making a plurality of prints, the strip may be moved forward in print-size increments after each print has been made. The dyecoats are usually uniform in thickness and colour, but for multicolour printing, uniform areas of different primary colours may be provided in sequence along the roll so that each colour in turn can be transferred to the same receiver sheet. Individual letters and numbers are printed by heating only those areas where dye transfer is required, pictures similarly being built up pixel by pixel as tiny heated elements in the printer head are pressed against the appropriate places on the back of the dyesheet.

The amount of dye which is transferred to the receiver is determined by the amount of heat supplied to the back of the dyesheet, so the optical density of each colour in each pixel of a print can be controlled by varying the temperature of the printer element and/or the length of time that the heat is applied. There are, however, several factors limiting the amount of heat which can be supplied to a dyesheet, including the short time available in a high speed printer, and the thermal stability of the dyesheet to the very high temperature impulses (e.g. above the softening temperature of the thermoplastic substrate) necessary for supplying sufficient heat in such short time intervals. We have now found that by placing an effective dye-barrier layer between the dyecoat and the substrate, the dyes can be transferred to the receiver using a smaller thermal pulse, or alternatively for a given thermal pulse, the optical density of the colours in the print can be enhanced; and we have devised a barrier composition which provides good dye-barrier properties without sacrificing adhesion between the substrate and dyecoat.

According to a first aspect of the invention, a dyesheet for thermal transfer printing, comprises a sheet-like substrate, a dyecoat containing a thermal transfer dye, and between them a dye-barrier layer consisting essentially of a reaction product of polymerising acrylic functional groups in a layer of a coating composition comprising: (a) an organic resin comprising at least one polyfunctional material having a plurality of pendant or terminal acrylic groups per molecule available for cross-linking, at least 50% by weight of the polyfunctional material having at least 4 acrylic functional groups per molecule; and (b) at least one linear organic polymer soluble or partially soluble in the resin, and comprising 1–40% by weight of the resin/polmer mixture.

A second aspect of the invention provides a coating composition comprising: (a) an organic resin comprising at least one polyfunctional material having a plurality of pendant or terminal acrylic groups per molecule available for cross-linking, at least 50% by weight of the polyfunctional material having at least 4 acrylic functional groups per molecule; (b) at least one linear organic polymer soluble or partially soluble in the resin, and comprising 1–40% by weight of the resin/polmer mixture; and (c) activation means responsive to thermal or optical stimulus for effecting polymerisation of the acrylic functional groups.

A third aspect of the invention provides a process for manufacturing dyesheets for thermal transfer printing, comprising coating a surface of a sheet-like substrate with a dye-barrier coating composition of the second aspect of the invention, applying the stimulus for effecting polymerisation of the acrylic functional groups thereby to provide a dye barrier layer on the substrate, and thereafter coating the dye barrier with a dyecoat composition.

The dye-barrier properties vary according to the degree of cross-linking through he polyfunctional resins, the effect of increasing the acrylic functional groups thus being to improve the colour densities of the resultant prints. However, this is at the expense of flexibility and adhesion, and the use of such resins on their own could lead to flaking of the barrier layer (and its overlying dyecoat) from off the substrate during handling, or larger areas of dye than the individual pixels may become transferred during printing. We have now found, however, that by using the resins in the composition specified herein, general lack of flexibility may be overcome, even to the extent in some cases of showing an improvement in the overall adhesion of the dyecoat to the substrate, all this while still providing prints with a noticeably improved colour density compared with those produced without a dye barrier layer under otherwise similar conditions.

The polyfunctional material can be a mixture, and the high functionality materials can be polymerised in the presence of resins of lower acrylic functionality, with which they react to form a common cross-linked matrix. A useful effect of including some lower functionality materials in this manner, is to increase the flexibility of the layer, but this is at the expense of its dye barrier properties. These lower functionality resins need to be added in addition to the linear polymers of component "b". (i.e. replacing the high functionality materials rather than the linear polymer) anyway, and on balance we find they provide little overall advantage. Our preferred composition is thus one in which substantially all of the polyfunctional material has 4 or more of the acrylic groups per molecule, preferably at least 6. It is clear from extrapolation of results obtained that higher acrylic functionality values, at least up to 8, would give even better barriers, but in view of the lack of general availability of such materials at present, the expected improvement in barrier properties with functionality values greater than 8 will have to remain a matter for conjecture.

We have also found that it is not only the number of acrylic functional groups per molecule that determines the efficacy of the barrier, but the density of these groups within the molecule. Thus materials having four acrylic groups on oligomers with a molecular weight of about 1000, (about the minimum density we like to use) will generally have a greater efficacy than the same number of acrylic groups on much bigger molecules, of 10.000 for example. The effect appears to be one of providing a matrix in which the closeness of the functional groups (and their resultant cross links) reduces the pore size sufficiently to restrict or prevent passage of the relatively large dye molecules through the pores of the matrix. This property can conveniently be expressed as a functionality density, the above example of our preferred minimum of four acrylic functional groups per 1000 units of molecular weight, thus representing a functionality density of 0.4 per 100 units, or 0.4%.

The polyfunctional materials of the resins may themselves be in the form an organic liquid, but where they are solids the resin may also include a solvent for the polyfunctional materials. As the coating composition has to be capable of being applied as an even coating onto the substrate film, it is desirable for the linear organic polymer (component b) to be completely soluble in the resin. However, we find that this is not essential providing that any emulsion formed by partially immiscible components is sufficiently stable to retain good dispersion throughout the coating process. Our preferred polyfunctional materials comprise molecules having an oligomer backbone selected from urethanes, epoxides and polyesters, to which backbone the acrylic groups are attached. The acrylic groups may include methacrylic groups. Examples include Ebecryl 810 (a polyester acrylate oligomer having a functionality of 4) and Ebecryl 220 (a straight aromatic urethane acrylate oligomer having a functionality of 6). The manufacturers literature quotes the latter as having a molecular weight of 1000, giving a functionality density (as defined above) of 0.6%, compared with our preferred minimum of 0.4%. Ebecryl resins are manufactured by UCB (chemicals sector), Speciality Chemicals Division, B-1620 Drogenbos, Belgium.

Low polyfunctionality materials which can be copolymerised in the resin with the above higher functionality materials include Ebecryl 600 (a straight epoxy acrylate oligomer having two functional acrylic groups per molecule, and functionality density of 0.4%), Sartomer SR 2000 (a long alkyl chain (C14/C15) diacrylate manufactured by Sartomer International Inc.), and Ebecryl 264 (an aliphatic urethane acrylate having 3 functional groups per oligomer, supplied as an 85% solution in hexandiol diacrylate, but having a functionality density of only 0.15%).

Optically curable resins having a short cure time are preferred, to enable in-line curing to be effected. For these the activator means (component c) includes sensitiser systems responsive to radiation of appropriate wavelength, this for most systems being UV radiation. Examples of such systems include Quantacure ITX and Quantacure EPD (both from Ward Blenkinsop), Irgacure 907 (from Ciba Geigy) and Uvecryl P101 (from UBC), and mixtures thereof. Sensitiser systems have also been developed recently for acrylic resins which can be used with radiation of visible wavelengths, thus avoiding the hazards associated with UV light.

Preferred linear organic polymers of component b are polymethylmethacrylate, polyvinyl chloride, linear polyesters and acrylated polyester polyols. Examples include Diakon LG156 polymethylmethacrylate and Corvic CL5440 vinyl choride/vinyl acetate copolymer (both from; Imperial Chemical Industries PLC), Ebecryl 436 linear polyester (supplied as a 40% solution in trimethylolpropane triacrylate by UCB) and Synacure 861X hydroxyfunctional acrylated polyester. All of these consist of linear molecules essentially free from functional acrylic groups, and are believed to remain entwined in the crosslinked matrix but not chemically bonded into it. We have found, however, that some acrylic functionality can be present in the linear polymer, but anything other than very small quantities of such compounds may have an adverse effect on the polymerisation reaction. An example of such materials is Macromer 13K-RC, a polystryl methacrylate manufactured by Sartomer International Inc. with a molecular weight quoted by the manufacturers as 13000. An effect of these polymers is to increase the viscosity of the coating composition and thereby assist in the laying down of a uniform coating layer. We find it also improves adhesion of the cured coating to the thermoplastic substrate film, and improves flexibility.

The invention is illustrated by the following example in which all parts are parts by weight.

Into 70 parts of Ebecryl 220 (a straight aromatic urethane acrylate resin having a functionality of 6) were dissolved 20 parts of Synacure 861X hydroxy functional acrylated polyester, and 10 parts of Diakon LG.156 polymethylmethacrylate. To this was added a sensitiser system consisting of:

2 parts of Quantacure ITX,
2 parts of Quantacure EPD,
4 parts of Irgacure 907, and
4 parts of Uvecryl P101.

This composition was coated by gravure onto 6 μm thick polyester film substrate to give a wet film thickness of about 2 μm. This was passed through an oven having high velocity air knives to strip off any solvent, and then irradiated with UV light on a heated drum at a temperature below the Tg of the linear polymer used (typically 80° C. when using Diakon LG 156), using a single 200 watt/in medium pressure mercury lamp as UV source, at a machine speed of 10–50 m/min, to give an exposure time to the UV radiation of about 0.1–0.5 s. The UV radiation effected a cure, and cross-linked the resin through the acrylic functional groups, thus providing a hard dye barrier layer adhered to the substrate film.

Onto this barrier layer was laid a dyecoat comprising a thermal transfer dye in a polymeric binder. On the other side of the substrate film was coated a backcoat composition consisting essentially of 10 parts of Ebecryl 220

76 parts of Ebecryl 600
14 parts of Synocure 861X
5 parts of zinc stearate
5 parts of finely divided talc, and
1 part ATMER 129 antistatic agent.

This backcoat composition was applied to the substrate film and was UV cured in essentially the same manner as the dye barrier layer, using the same sensitiser system. The purpose of this backcoat was primarily to protect the thermoplastic substrate film from the intense heat applied to that other side in short impulses by the printer head during the printing process. Typically temperatures as high as 400° C. (i.e. well above the softening temperature of the thermoplastic material) may be applied for very short periods.

A reference sample Was also prepared, having a polyester base film, dyecoat and backcoat having the same composition and prepared in the same manner as that in the first sample, the two samples thus being essentially the same except that the reference sample did not have any dye barrier layer.

The dyesheets thus prepared were placed adjacent to a receiver sheet and passed through a printer. The printer head used was a Kyocera KMT 85, having 6 pixel/mm. Head pressure at the printing point was 6 kg with a platten Shore hardness of 40–45. Maximum print power was 0.32 watt/dot, and signals of various strengths within the range were applied to the printer head within the available range.

Prints obtained using dyesheets having the dye barrier layer had a noticably deeper colour than those made using the reference sample.

A further reference sample was prepared for comparison purposes, with an intermediate layer essentially as the dye-barrier layer but from which the crosslinkable acrylate was absent. Even when using the printer at maximum power, this further sample gave prints with an optical density little changed from that of the reference sample having no intermediate layer. The compositions of the two intermediate layers are shown in the table below, the first being the composition according to the present invention, while that headed "non-crosslinked composition" is that of the further reference sample. The amounts are given as parts by weight.

| component | amount for crosslinked composition | amount for non-crosslinked composition |
|---|---|---|
| Ebecryl 220 | 70 | none |

-continued

| component | amount for crosslinked composition | amount for non-crosslinked composition |
|---|---|---|
| Synocure 861 X | 20 | 80 |
| Diakon LG 156 | 10 | 20 |

To illustrate graphically the effect of having a dye barrier layer of the present invention, the optical densities (OD) obtained at different pulse widths were plotted for both of the dyesheets having barrier layers according to the compositions set out in the table above, and the graph as set forth in FIG. 1 attached hereto.

All the above samples (including that having no intermediate layer) were also tested for adhesion of the dyecoat to the substrate, by pressing on a piece of adhesive tape, the pealing this back. The sample without an intermediate layer could have its dyecoat stripped off with ease. Both of those with intermediate layers showed much better adhesion, especially that having only the linear polymer.

We claim:

1. A dyesheet for thermal transfer printing, comprising a sheet-like substrate, a dyecoat comprising a thermal transfer dye in a polymer binder, and between them an intermediate dye-barrier layer consisting essentially of: (a) a cross-linked reaction product of polymerising acrylic functional groups in an organic resin comprising at least one polyfunctional material having a plurality of pendant or terminal acrylic groups per molecule available for cross-linking, at least 50% by weight of the polyfunctional material having at least 4 acrylic functional groups per molecule; and (b) at least one linear organic polymer soluble or partially soluble in the resin, and comprising 1–40% by weight of the resin/polymer mixture.

2. A dyesheet as claimed in claim 1, in which substantially all of the polyfunctional material has 4 or more of the acrylic groups per molecule.

3. A dyesheet as claimed in claim 1 or claim 2, in which the polyfunctional material has a functionality density of at least 0.4 acrylic groups 100 units of molecular weight.

4. A dyesheet as claimed in claim 1, in which the polyfunctional material comprises molecules having an oligomer backbone selected from urethanes, epoxides and polyesters, to which the acrylic groups are attached.

5. A dyesheet as claimed in claim 1, wherein the linear organic polymer of component b is selected from polymethylmethacrylate, polyvinyl chloride, linear polyesters and acrylated polyester polyols.

* * * * *